US005739739A

United States Patent [19]

Muramatsu et al.

[11] Patent Number: 5,739,739

[45] Date of Patent: Apr. 14, 1998

[54] FUSE STRUCTURE

[75] Inventors: Kenji Muramatsu; Goro Nakamura, both of Shizuoka, Japan

[73] Assignee: Yazaki Corporation, Tokyo, Japan

[21] Appl. No.: 758,886

[22] Filed: Dec. 2, 1996

[30] Foreign Application Priority Data

Dec. 1, 1995 [JP] Japan ..... 7-314482

[51] Int. Cl.[6] ..... H01H 85/045

[52] U.S. Cl. ..... 337/234; 337/264; 337/295; 337/261; 337/186; 439/621; 439/850

[58] Field of Search ..... 337/186, 159, 337/238, 239, 261, 295, 240, 260, 219, 197, 198, 142, 190, 195, 401, 405, 407, 414, 415; 439/621, 622, 830, 850; 361/104, 642, 626, 833

[56] References Cited

U.S. PATENT DOCUMENTS 5,294,906 3/1994 Totsuka ..... 337/260
5,416,461 5/1995 Totsuka ..... 337/261

FOREIGN PATENT DOCUMENTS 6-13043 2/1994 Japan ..... H01H 85/54

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A fuse including a fusible link element having a pair of terminal portions and a fusible portion through which the terminal portions are connected to each other, the terminal portions having upward locking pieces at upper corners thereof, a housing for receiving the fusible link element, having stepped recesses between inner and outer walls thereof in which end portions of the upward locking pieces are fitted when the upward locking pieces are bent inwardly, and a housing cover for closing an open end of the housing, having legs which are extended towards the housing so that the legs are abutted against the end portions of the upward locking pieces when the cover is fitted to the housing, lower ends of the legs having taper surfaces brought into contact with the outer sides of the upward locking pieces.

4 Claims, 6 Drawing Sheets

FUSE STRUCTURE

BACKGROUND OF THE INVENTION

1. Field of the Invention

This invention relates to a fuse structure including a fusible link element, a housing for accommodating the fusible link element, and a housing cover closing an end opening of the housing.

2. Background

A fuse applied to a wire harness connecting connector in an automobile will be described with reference to FIGS. 6 through 9.

A fuse 1, as shown in FIG. 6, includes a housing 3 accommodating a fusible link element 2, and a housing cover 4 which closes an upper opening of the housing 3. As is seen from an exploded perspective view of FIG. 7, the fusible link element 2 has four upper corners, and has upward locking pieces 2*a* and lower terminal portions 2*b* at the four upper corners, and a fusible portion 2*c*. The housing 3, as shown in FIG. 9 which is a fragmentary sectional view taken along the line 9—9 in FIG. 6, includes an inner wall 3*a*, an outer wall 3*b*, stepped recesses 3*c* between the inner wall 3*a* and the outer wall 3*b*, and protrusions 3*d* which are protruded from an outer surface of the outer wall 3*b* as shown in FIG. 7. The upper opening of the housing 3 is covered with the housing cover 4, and the housing cover 4 is fixedly secured to the housing 3 with the protrusions 3*d* of the housing engaged with locking openings 4*a* formed in the side walls of the housing cover 4.

The above-described fuse 1 is assembled as follows: First, the fusible link element 2 is set in the housing 3, and then the upward locking pieces 2*a* are fitted in the stepped recesses 3*c* between the inner wall 3*a* and the outer wall 3*b* by bending them inwardly with a tapered tool such as a screw driver.

On the other hand, Unexamined Japanese Utility Model Publication No. Hei. 6-13043 has disclosed a fuse structure in which a fuse element accommodated in a housing is locked to a locking step portion of the housing with a lance formed on a side wall of the fuse element, and legs of the housing depress a upper shoulder of the fuse element, so that the fuse element is fixedly set at a predetermined position.

The above-described first example of the conventional fuse structure, is disadvantageous in the following points: After assembling the fuse, the upward locking pieces at the four corners must be bent inwardly. That is, the fuse structure is low in work efficiency. The upward locking pieces, being manually bent, are low in the accuracy of bend, so that the fuse element is not positively locked nor fixed in the housing.

Furthermore, in the case of the fuse structure disclosed by the aforementioned Publication No. Hei 6-13043, the legs of the housing cover are to push the upper shoulder of the fuse element, and the fuse element is secured to the housing by the engagement of the locking step of the housing with the lance provided on the side wall of the fuse element.

SUMMARY OF THE INVENTION

Accordingly, an object of the invention is to provide a fusible link housing cover which, in order that a fusible link element having upward locking elements at its upper corners be positively and accurately positioned and fixed in a housing, has legs which serve as jigs in the assembling work.

The foregoing object of the invention has been achieved by the provision of a fuse including a fusible link element having a pair of terminal portions and a fusible portion through which the terminal portions are connected to each other, the terminal portions having upward locking pieces at upper corners-thereof, a housing for receiving the fusible link element, having stepped recesses between inner and outer walls thereof in which end portions of the upward locking pieces are fitted when the upward locking pieces are bent inwardly, and a housing cover for closing an open end of the housing, having legs which are extended towards the housing so that the legs are abutted against the end portions of the upward locking pieces when the cover is fitted to the housing, lower ends of the legs having taper surfaces brought into contact with the outer sides of the upward locking pieces.

In the housing cover of the invention, the taper surfaces of the legs of the cover are brought into contact with the upward locking pieces formed at the corners of the fusible link element. Upon depression of the cover, the upward locking pieces, being pressed are further bent, thus being positively fitted in the recesses formed in the housing. With the housing cover engaged with the housing, the upward locking pieces are bent while the fusible link element is regulated in position. In other words, the housing cover serves as a jig in assembling the fuse.

DETAILED DESCRIPTION OF THE PREFERRED EMBODIMENTS

Figure 1:
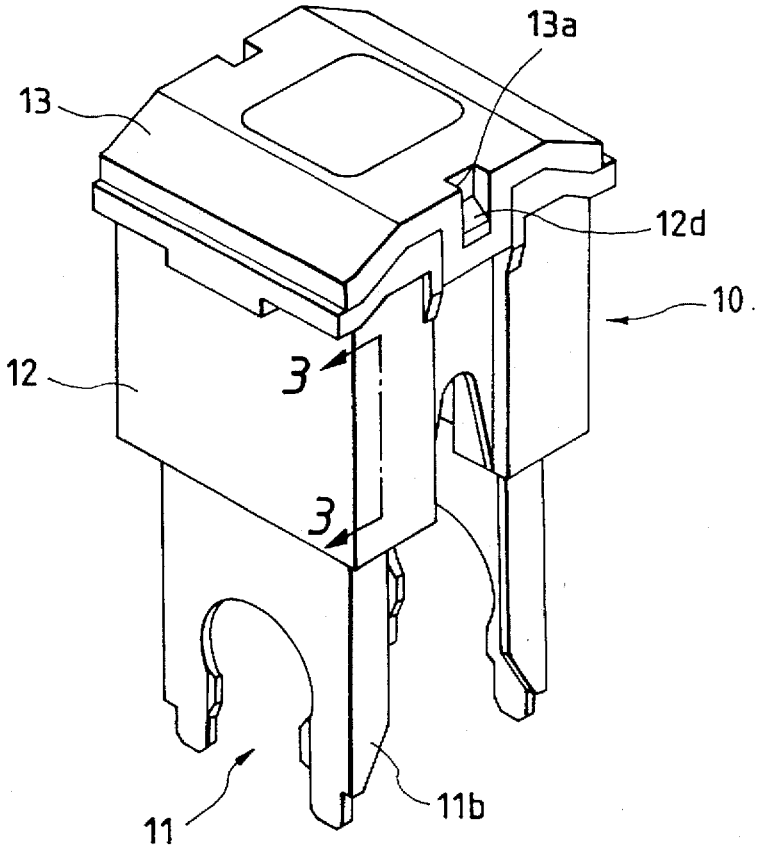
FIG. 1 is a perspective view outlining the arrangement of a fuse structure employing a housing cover according to the invention.

In FIG. 1, reference numeral 10 designates a fuse of the invention. The fuse 10 includes a fusible link element 11 of fusible metal, a plastic housing 12 for accommodating the fusible link element 11, and a plastic housing cover 13 closing an upper opening of the housing 12.

Figure 2:
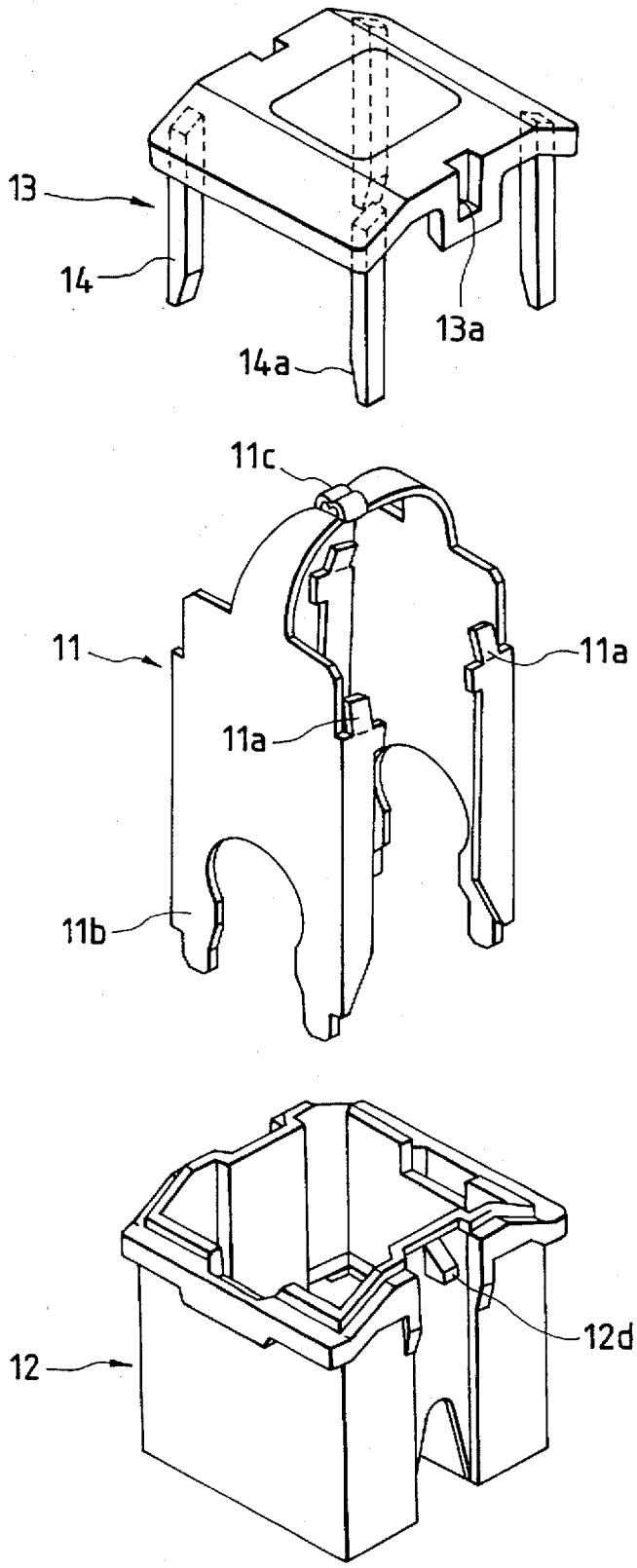
FIG. 2 is an exploded perspective view of a fuse structure shown in FIG. 1.
Figure 3:
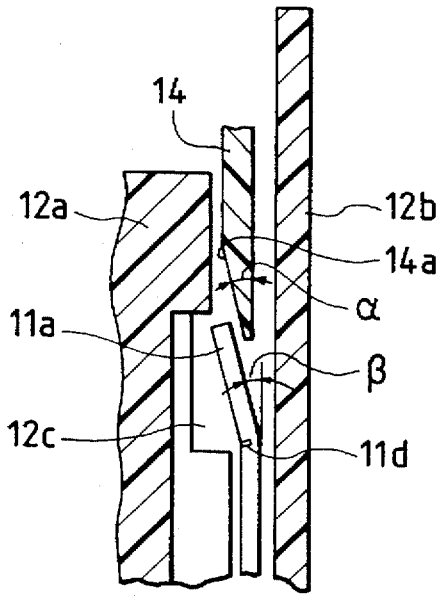
FIG. 3 is a sectional view taken along the line 3—3 in FIG. 1.
Figure 4:
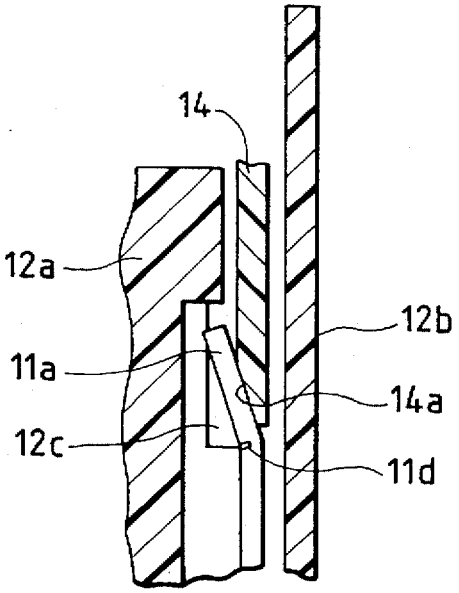
FIG. 4 is a sectional view, corresponding to FIG. 3, for a description of the function of a leg of the cover.

The fusible link element 11 has four corners. Further, the fusible link element 11 has tongue-shaped upward locking pieces 11*a* and lower terminal portions 11*b* at each of the four corners, and a fusible portion 11*c*. The upward locking pieces 11*a* are bendable. And the upward locking pieces 11*a* have bending grooves 11*d* as shown in FIGS. 3 and 4. As shown in FIG. 3, the housing 12 includes an inner wall 12*a*, an outer wall 12*b*, and stepped recesses 12*c* between those walls 12*a* and 12*b*. Furthermore, as shown in FIG. 2, in the housing 12, protrusions 12*d* are extended from the outer surface of the outer wall 12*b*. The upper opening of the housing 12 is closed with the housing cover 13. The housing cover 13 has locking openings 13*a* in its side walls, which are engaged with the protrusions 12*d* of the housing 12 so that the housing cover 13 is fixedly secured to the housing 12.

The housing cover 13 has four legs respectively at four corners which are extended in the direction of engagement of the housing cover with the housing 12. The lower end portions of the four legs have taper surfaces 14*a*. Each of the taper surfaces 14*a* serve as a jig to bend the respective upward locking piece 11*a* of the fusible link element 11 towards the inner wall 12*a* of the housing 12.

As is seen from FIGS. 3 and 4, in assembling the fuse, the upward locking pieces 11*a* of the fusible link element 11 are slightly bent inwardly along the grooves 11*d* before inserted into the housing, manually. After the fusible link element 11 is set at predetermined position, for instance, after the fusible link element 11 is pushed into the housing 12 until the upward locking pieces 11*a* are positioned, the housing cover 13 is engaged with the opening of the housing 12. In this operation, the legs extended downwardly from the four corners of the housing cover 13 are inserted into the housing 12, so that the taper surfaces 14*a* of the legs 14 are brought into contact with the ends of the upward locking pieces 11*a*. When the housing cover 13 is further depressed, the legs 14 are moved down the outer surfaces of the upward locking pieces 11*a* because the legs 14 have the taper surfaces at the ends, and at the same time the upward locking pieces 11*a* are bent towards the inner wall 12*a* of the housing 12, and their end portions are engaged with the recesses 12*c*. In this case, it is preferable that the angle $\alpha$ of the end portion of the taper surface 14*a* of each of the legs 14 is equal to the angle $\beta$ between the outer wall 12*b* of the housing 12 and each of the upward locking pieces 11*a*. That is, in the case where $\alpha=\beta$, the taper surfaces 14*a* of the legs 14 are positively brought into close contact with the outer surfaces of the upward locking pieces. Hence, the upward locking pieces 11*a* are sufficiently bent, and inserted into the recesses 12*c* formed in the inner wall 12*a* of the housing 12.

As is apparent from the above description, the taper surface 14*a* of each of the legs 14 is brought into plane contact with the respective upward locking piece 11*a* at the angle $\alpha$ which is equal to the angle $\beta$ through which the upward locking piece 11*a* has been bent in advance when the fusible link element 11 is inserted into the housing 12. Hence, when the housing cover 13 is completely coupled to the housing 12, the upward locking pieces are completely brought into contact with the taper surfaces 14*a* of the legs 14, that is, the fusible link element 11 is completely engaged with the housing 12. In this case, the state of closure of the housing with the housing cover 13 represents the state of engagement of the fusible link element with the housing. That is, both the state of engagement of the cover with the housing and the state of engagement of the fusible link element with the housing cam be detected at the same time.

Figure 5:
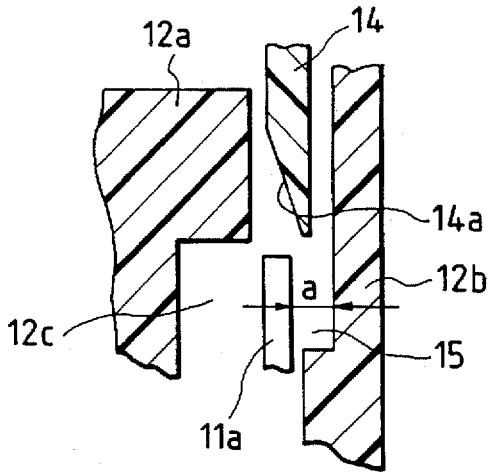
FIG. 5 is a sectional view, corresponding to FIG. 3, for a description of one modification of the fuse structure.
Figure 6:
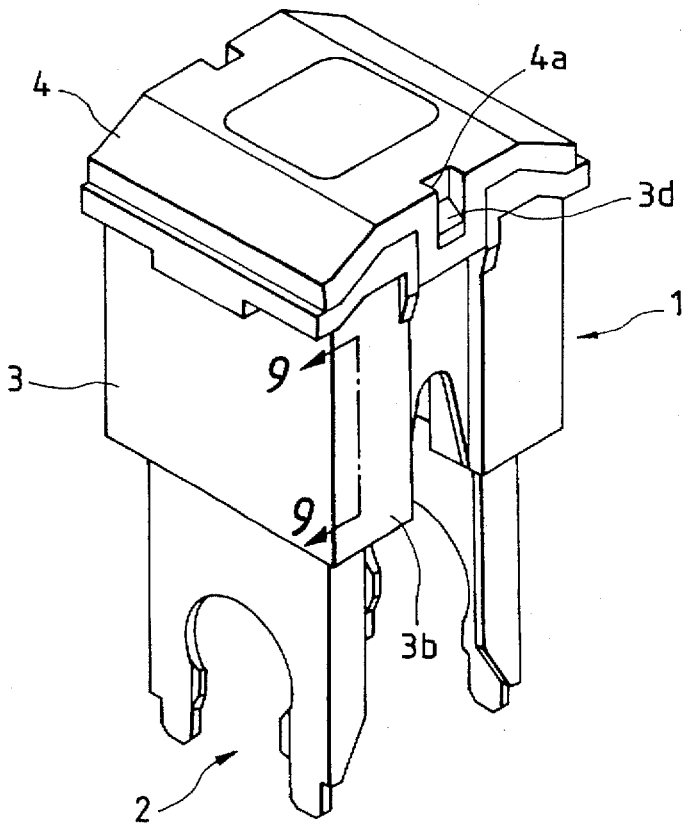
FIG. 6 PRIOR ART
FIG. 6 is a perspective view outlining the arrangement of a conventional fuse structure.
Figure 7:
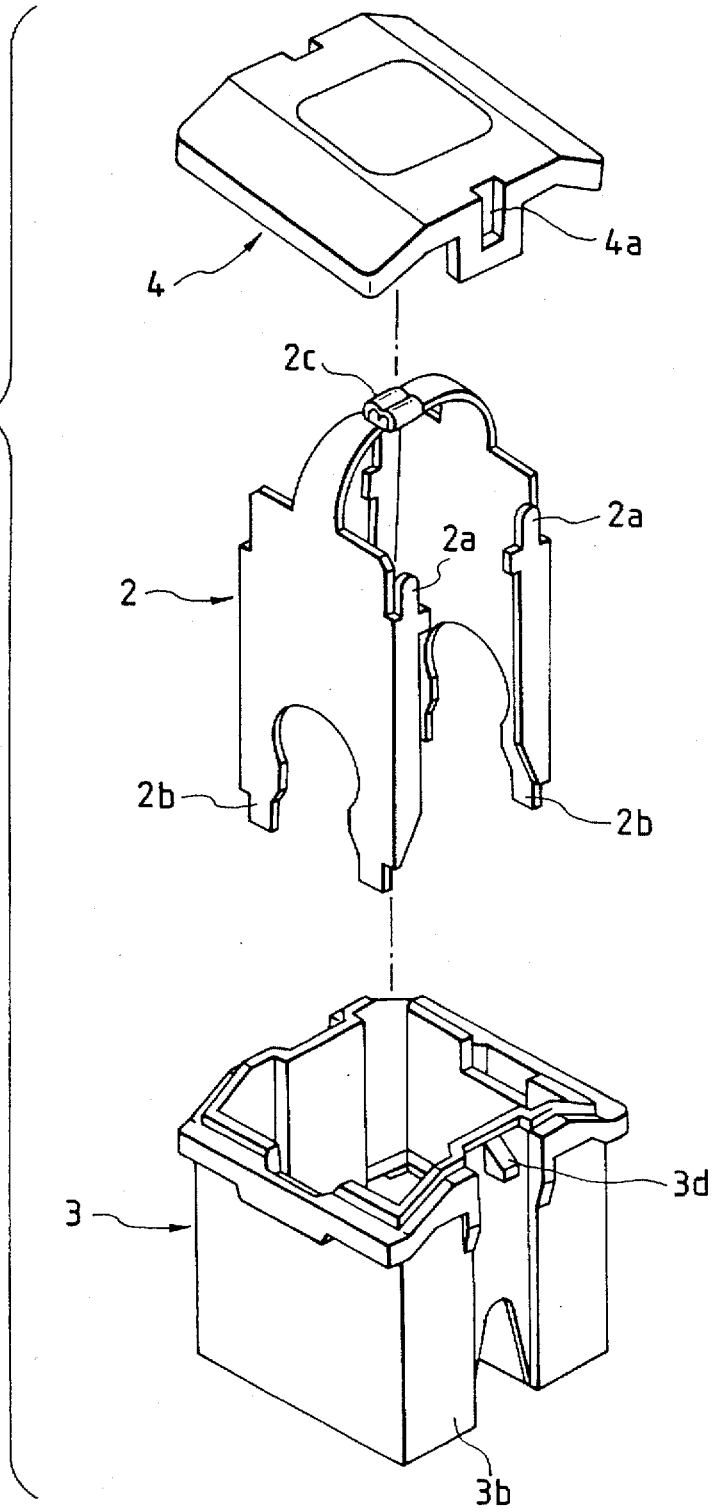
FIG. 7 PRIOR ART
FIG. 7 is an exploded perspective view of the conventional fuse structure shown in FIG. 6.
Figure 8:
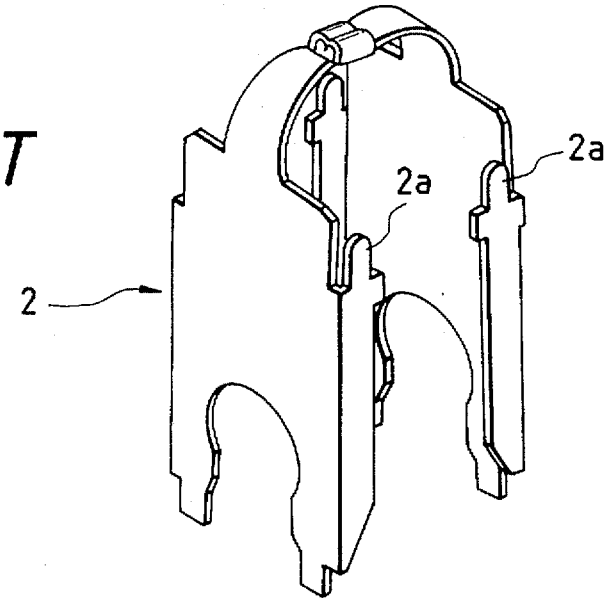
FIG. 8 PRIOR ART
FIG. 8 is a perspective view for a description of the bending of upward locking pieces of a fusible link element forming the conventional fuse structure.
Figure 9:
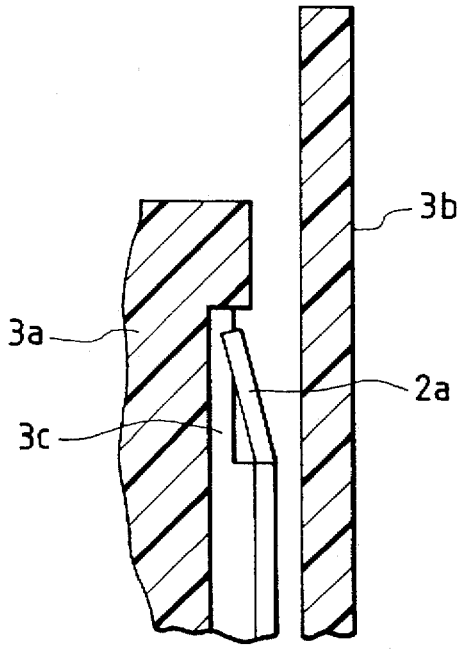
FIG. 9 PRIOR ART
FIG. 9 is a sectional view, with parts cut away, taken along the line 9—9 in FIG. 6.

FIG. 5 shows one modification of the above-described fuse structure of the invention. In the modification, in order to readily and positively bring the ends of the upwards locking pieces 11*a* of the fusible link element 11 into contact with the taper surfaces 14*a* of the legs 14 of the housing cover 13, vertical-groove-like cuts 15 are formed in the inner surface of the outer wall 12*b* of the housing 12 in such a manner that a predetermined distance a is provided between each of the upward locking pieces 11*a* and the bottom of each of the vertical-groove-like cuts 15, whereby the end portion of each of the legs 14 has a clearance space when elastically deformed in a horizontal direction. The modification is advantageous in that, even if the upward locking pieces 11*a* are somewhat smaller in the angle of bend when manually bent along the grooves 11*d*, the upward locking pieces are positively brought into contact with the taper surfaces 14*a* of the legs 14, because the upward locking pieces and the taper surfaces 14*a* of the legs 14 are elastically brought into contact with each other.

As is apparent from the above description, the fusible link housing cover of the invention has the following effects or merits: The work of locking the fusible link element to the housing is improvised in efficiency. In addition, the legs of the housing cover are fitted tight in the housing, and the upward locking pieces are brought completely into plane contact with the legs, so that the upward locking pieces are positively locked to the inner wall of the housing. Furthermore, a state of engagement of the housing cover with the housing can be visually detected.

What is claimed is:

1. A fuse, comprising:

a fusible link element including a pair of terminal portions and a fusible portion through which said terminal portions are connected to each other, said terminal portions having upward locking pieces at upper corners thereof;

a housing for receiving said fusible link element, having stepped recesses between inner and outer walls thereof in which end portions of said upward locking pieces are fitted when said upward locking pieces are bent inwardly; and a housing cover for closing an open end of said housing, having legs which are extended towards said housing so that said legs are abutted against said end portions of said upward locking pieces when said cover is fitted to said housing, lower ends of said legs having tapes surfaces brought into contact with said outer sides of said upward locking pieces.

2. The fuse of claim 1, wherein said outer wall of said housing has cut portions which are formed to allow said legs to elastically deform.

3. The fuse of claim 2, wherein when said cover is fitted to said housing, a predetermined distance is provided between each end portion of said upward locking pieces and each of said cut portions.

4. The fuse of claim 1, wherein said stepped recesses are formed in said inner walls of said housing, respectively.

* * * * *